US005089053A

United States Patent [19]

Chou et al.

[11] Patent Number: 5,089,053

[45] Date of Patent: Feb. 18, 1992

[54] CONTACT LENS CLEANING MATERIAL AND METHOD

[75] Inventors: Maylee H. Chou, Lexington; Edward J. Ellis, Lynnfield, both of MA

[73] Assignee: Polymer Technology Corporation, Wilmington, Mass.

[21] Appl. No.: 434,412

[22] Filed: Nov. 9, 1989

[51] Int. Cl.[5] ..... B08B 3/08

[52] U.S. Cl. ..... 134/7; 252/545; 252/89.1; 252/155; 252/174.13; 252/174.18; 252/174.23; 252/174.25; 252/551; 252/DIG. 14

[58] Field of Search ..... 134/6, 7; 252/545, 89.1, 252/155, 173, 174.17, 174.18, 174.23, 174.25, 550, 551, DIG. 14

[56] References Cited

U.S. PATENT DOCUMENTS

| | | | |
|---|---|---|---|
| 3,884,826 | 5/1975 | Phares, Jr. et al. | 252/106 |
| 3,943,234 | 3/1976 | Roggenkamp . | |
| 3,950,417 | 4/1976 | Verdicchio et al. . | |
| 4,224,195 | 9/1980 | Kawasaki et al. | 252/546 |
| 4,259,202 | 3/1981 | Tanaka et al. | 252/107 |
| 4,284;534 | 8/1981 | Ehrlich | 252/542 |
| 4,306,997 | 12/1981 | Oneto et al. | 252/541 |
| 4,394,179 | 7/1983 | Ellis et al. | 134/7 |
| 4,500,441 | 2/1985 | Tanaka et al. | 252/89.1 |
| 4,655,957 | 4/1987 | Chromecek et al. | 252/174.23 |

FOREIGN PATENT DOCUMENTS

| | | |
|---|---|---|
| 1040543 | 9/1966 | United Kingdom . |
| 2101350 | 1/1983 | United Kingdom . |

*Primary Examiner*—Asok Pal

*Attorney, Agent, or Firm*—Wolf, Greenfield & Sacks, P.C.

[57] ABSTRACT

New contact lens cleaning materials are designed for use in cleaning fluorine and silicon containing hard contact lenses. The contact lens cleaning materials are water based and contain an alkylphenyl polyether alcohol surfactant and an anionic second surfactant selected to have good cleaning action with respect to protein and mucous-like material deposits.

10 Claims, No Drawings

CONTACT LENS CLEANING MATERIAL AND METHOD

BACKGROUND OF THE INVENTION

It has long been recognized in the art that contact lenses must remain free of surface deposits in order to maintain their wearing comfort and optimum vision, and to reduce the potential for ocular change. However, contact lenses are susceptible to acquiring surface deposits from exogenous sources (mascara, hair spray and the like) and endogenous sources (mucous, oily secretions, protein secretions and the like). It was recognized that silicon, and particularly silicone, containing contact lenses are very vulnerable, perhaps more so than prior methyl methacrylate type contact lenses, to the acquisition of tenacious, waxy surface deposits often containing mucous and proteins which are difficult to totally remove without damaging the lenses. With the advent of fluorine containing hard contact lenses coming into commercial usage, the problems of protein and mucous deposits have lessened, however somewhat different deposits occur on lenses after use in the eye. Such deposits are oily and lipid like and are not easily removed by prior art cleaners.

As set forth in U.S. Pat. No. 4,394,179, previous hard and soft contact lens cleaning solutions have used a variety of water soluble cleaning agents, in addition to water soluble hydrating polymers in sterile homogeneous aqueous solutions. In one silicone lens cleaning material of the type set forth in U.S. Pat. No. 4,394,179, an abrasive, surface active agent and suspending agents have been used in an aqueous media to provide a good hard contact lens cleaning solution for silicone containing lenses. In another prior art cleaner, alkylphenyl polyether alcohol surfactants have been used in cleaner compositions. See for example, U.S. Pat. Nos. 4,734,222; 4,543,200; 3,884,826; 4,374,745; 4,421,665; 4,533,399; 4,622,258 and 4,678,698. Numerous other contact lens cleaning solutions have been known in the long history of contact lens use. Various surfactants and combinations of surfactants with other materials are long known for use.

However, applicants have now found that that the use of at least two surfactants in combination, one of which is an alkylphenyl polyether alcohol, along with another surfactant which is selected for its ability to remove mucous and protein deposits from hard contact lenses, is particularly desirable, especially when used in conjunction with abrasive particles.

SUMMARY OF THE INVENTION

It is an object of this invention to provide a hard contact lens cleaning material designed for cleaning hard contact lenses formed of silicon and fluorine containing polymers, after said lenses have been used in the eye, which cleaning material comprises an alkylphenyl polyether alcohol surfactant and at least one other surface active agent, which agent is particularly useful in removing protein and mucous like deposits.

Still another object of this invention is to provide a contact lens cleaning solution in according with the preceeding object which is safe, effective and can be used to remove deposits from contact lenses of many types, rapidly and efficiently by untrained persons in ordinary usage of contact lenses.

Still another object of this invention is to provide methods for cleaning contact lenses containing fluorine and silicon containing polymers on contact lens surfaces by applying a solution to said surfaces of an alkylphenyl polyether alcohol surfactant and a second surfactant desiqned to have good cleaning properties with respect to protein and mucous deposits and cleaning the contact lens surface without changing the power of the contact lenses or significantly scratching the lenses.

According to the invention, a contact lens cleaning material designed for cleaning hard contact lenses formed of silicon, such as silicone, and fluorine containing polymers after said lenses have been used in the eye, has an anionic surface active agent selected to have good cleaning action with respect to protein and mucous like material deposits. A second surface active agent or surfactant, different than the first mentioned surface active agent, is admixed therewith and is an alkylphenyl polyether alcohol surfactant. The two surfactants are carried by an aqueous suspending vehicle. Preferably, an inorganic abrasive is incorporated into the solution formed, along with separate means to maintain the the surface active agent, alkylphenyl polyether alcohol and abrasive particles in a substantially uniform suspension, so that the suspension is capable of cleaning contact lenses without adversely affecting or scratching the lenses and without changing the power of the lenses, as for example when mechanical rubbing action of the finger or a cloth is used to apply the solution and rub it against the lens.

Preferably, the surface active agent first mentioned has the following formula:

$$C_nH_{2n+1}(CH_2CH_2O)_xSO_x^-R^+$$

where x varies from 0 to 10 n varies from 8 to 20

$R^+$ is $Na^+$, $K^+$, $NH_4^+$ $\frac{1}{2}$ $Mg^{++}$ $(CH_1CH_2OH)_3NH^+$

The inorganic abrasive is preferably a water insoluble inorganic compound, as for example silica gel, preferably having an average particle size of no more than about 20 microns, and more preferably an average particle size of from about 0.5 to 5 microns.

It is a feature of this invention that a cleaning solution can be applied to the surface of fluorine and silicone containing lenses, with mild rubbing or abrasion, to remove unwanted surface deposits, if present, without imparting substantial scratches to the lens surfaces and without changing the curvature or power of the lens surfaces. When used properly, the cleaner may not only clean the surface of the lens, but provide a very slight polishing action to remove any scratches present, thus restoring optical inteqrity of the lens surface. The material is preferably a liquid solution, but can be in the form of a paste or gel. If polishing action is required, proper abrasive materials can be chosen to increase the polishing action, although that is not preferred for the cleaner applications of this invention.

In addition to advantages of using a surface active agent and abrasive particle, as set forth in said U.S. Pat. No. 4,394,179, the use of the alkylphenyl polyether alcohol surfactant is found to qreatly enhance the cleaning power of the solution, particularly with respect to lipid deposits otherwise occuring on the lens.

In a preferred embodiment, a third surfactant and preservative is used in small amount to further enhance the cleaning and preservative action of the solution. Surprisingly, this third surfactant can be a cationic and is found not to adversely interact with any anionic surfactant used to enhance mucous and protein deposit removal.

DESCRIPTION OF PREFERRED EMBODIMENT

The preferred formulation of the novel contact lens cleaning solution of this invention utilizes a surface active agent which is preferably anionic, a nonionic surfactant, an abrasive, a suspending agent to form a stable suspension in aqueous solution, and can have a third surfactant, preservative or other conventional contact lens cleaning additives added thereto.

The preferred anonic surface active agent which is different from and preferably used in conjunction with the alkylphenyl polyether alcohol surfactant, is selected to have good cleaning action with respect to protein and mucous like material deposits and is preferably an anionic sulfate conforming to the following general structure:

$$C_nH_{2+}(CH_2CH_2O)_xSO_3^-R^+$$

where x varies from 0 to 10 n varies from 8 to 20

$R^+$ is $Na^+$, $K^+$, $NH_4^+$ $\frac{1}{2}$ $Mg^+$ $(Ch_2CH_2OH)_3NH^+$

Examples of such detergents include:

sodium lauryl sulfate
sodium cetyl sulfate
sodium octyl sulfate
sodium tridecyl sulfate
sodium oleyl sulfate
sodium tridecyl ether sulfate
triethanolamine lauryl sulfate
ammonium lauryl ether sulfate
sodium lauryl ether sulfate
magnesium lauryl sulfate Preferably, the alkylphenyl polyether alcohol surfactants have the formula:

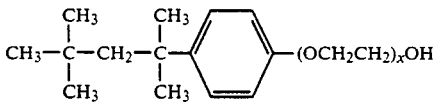

where x is from 3 to 12, but preferably 9 or 10. Preferred surfactants include octyl phenol polyethoxyethanol and specific alkylphenyl polyether alcohols in accordance with the above formula where x=3, 5, 7–8, 7, 8, 9–10, 9, 10 and 12.

Triton trademark products sold by Rohm and Haas Company of Philadelphia, Pennsylvania are preferred for use in the combinations of this invention.

The abrasive materials or compounds are water insoluble compounds employed for their abrasive characteristics. The abrasive material is preferably inorqanic and is a relatively hard, tough substance composed of irregularly shaped particles and ordinarily used for grinding, smoothing and polishing. In general, the abrasive industry teaches that fine grinding abrasives have average particle sizes ranging between 10 and 100 microns, while polishing abrasives have average particle sizes below 10 microns. Preferably, the particles of this invention have average particle sizes of about 0.5 to 5 microns and preferably under about 20 microns. The parameters that determine the utility and effectiveness of an abrasive, as ordinarily understood, include particle size, distribution, particle shape, particle density and particle hardness. Abrasive particles found to be most effective are:

alumina—calcined, hydrates, tabular
silica—amorphous, synthetic such as silica qel
aluminium silicate
magnesium
barium sulfate
magnesium carbonate
calcium carbonate
magnesium oxide
titrinium dioxide
zirconium oxide
cerium oxide
cesium oxide
pumice Preferably, silicas such as amorphous, or synthetic silicas, including silica qels, are preferred for use in this invention. Such silica gels useful in the invention are described in U.S. Pat. No. 4,394,179, which is incorporated by reference herein.

Said U.S. Pat. No. 4,394,179 further describes suspending agents useful in the cleaners of this invention, which agents provide a stable suspension of the abrasive in the cleaning solution, along with the surfactants used. Such suspensions can be achieved by increasing the viscosity of the aqueous solution through the addition of soluble salts and/or hydrophilic polymers, or by the addition of water soluble neutral or ionic polymers which can interact with the surface of one or more inorganic abrasive particles, thus preventing or hindering precipitation from occurring.

Suspending agents useful in the present invention can be one or more of the following:

alkali metal halides
alkaline earth metal salts
poly vinyl alcohol
polyacrylamide
hydrolyzed polyacrylamide
crosslinked polyacrylic acid
polyacrylic acid
xanthan gum
hydroxyethyl cellulose
hydrolyzed polyacrylonitrile starch
carboxymethyl cellulose
cellulose sulfate
methyl cellulose
methyl hydroxyethyl cellulose
methyl hydroxypropyl cellulose
poly-N-vinylpyrrolidone
guar gum
carboxymethyl guar qum
hydroxyethyl guar gum, hydroxypropyl guar qum
hydrolyzed polyacrylonitrile 2-acrylamido-2-methylpropane sulfonate starch clays such as bentonite, montorillonite and hectorite neutral, cationic and anionic detergents partially acetylated cellulose gelatin
polyethylene glycol and oxide, polyethylene oxide/polypropylene oxide block copolymers
K-carageenan Buffering agents can be used and are preferably those commonly employed in the art within a pH range of 5 to 8, and usually between 6.3 to 7.5. Such buffers include boric acid, sodium borate, phosphoric acid, disodium phosphate and sodium bicarbonate.

The use of salts as suspending agents qenerally renders the cleaning solution sterile; however, in cases where sterility must be imparted, anti microbial compounds can be used. Such compounds include chlorhexidine and its salts, benzalkonium chloride, phenyl mercuric acetate, polyamino propyl biguanide, phenethyl alcohol, methyl or propyl paraben, cetyl pyridinium chloride, thimersol and the like, in possible conjunction with EDTA.

Frangrances such as wintergreen or peppermint can be used if desired.

In the simplest fashion, the contact lens is cleaned by immersing the lens in the cleaning solution or spraying the lens and by providing agitation of the solution such as by rubbing, shaking, or wiping of the cleaning solution on the lens surface. The lens is then rinsed with water and inserted directly into the eye or it is placed in a soaking and/or wetting solution prior to insertion.

Preferably, the first surface active agent which is an anionic surface active agent, is used in amounts of from 0.1 to 30% by weight of the solution. The alkylphenyl polyether alcohol surfactant is used in amount of from 0.1 to 30% by weight. The aqueous suspending vehicle is used in amount of from 20 to 99.8% by weiqht. The inorganic abrasive is used in amounts of from 0 to 15% by weight of the solutions, and the separate means to maintain the suspension are used in amount of from 0 to 25% by weight.

A further surfactant and preservative in minor amounts of from 0.5 to 5% by weight of the entire composition is useful in some combinations. Such further surfactant has been found to add to what is believed to be the synergistic reaction of the combined surfactants described above. When a further or third surfactant is used preferably, the anionic surfactant is in the amount of 5 to 15% by weight, alkylphenyl polyether alcohol is 1 to 10% by weiqht, aqueous suspending vehicle is 50 to 94% by weiqht, abrasive from 0.1 to 5%, and separate means is 5 to 15% by weight. When used, the separate means and abrasive are preferably each used in amounts of at least 0.1% by weight.

Monoquat PTC, a trademark product of Mona Industries, Inc., of Paterson, N.J., a triquaternary phosphate ester surfactant which is cationic, can be used and has been found to be particularly useful to enhance what is believed to be a synerqistic reaction between all of the surfactants used. This material has a preservative action and is compatible with the anionic surfactant, as for example, Sipex EST-30, a trademark product of Alcolac Co. of Baltimore, Md., containing a sodium tridecyl ether sulfate. Surprisingly, the third surfactant can be a cationic surfactant and can be selected so as to avoid any adverse interaction with the anionic surfactant used.

The following illustrative examples are meant for illustrative purposes only and are not to be considered as limiting of the invention.

EXAMPLE I

| Formulation | % by weight |
|---|---|
| sodium tridecyl ether sulfate (30% in $H_2O$) (Sipex EST-30) | 5% |
| octylphenyl polyether alcohol (Triton X100) | 2% |
| Carboxymethylcellulose (CMC) | 0.1% |
| $Na_2HPO_4$ | 0.28% |
| $NaH_2PO_4$ | 0.55% |
| NaCl | 1% |
| Distilled water Q.S. | 100% |

The sodium chloride was dissolved in the water, followed by the addition of phosphate buffer. Once the phosphate buffer had been dispersed thoroughly, the CMC and the surfactants were added one by one and mixing continued until a smooth solution mixture was achieved.

EXAMPLE II

| Formulation | % by Weight |
|---|---|
| Sodium tridecyl ether sulfate (Sipex EST-30) | 20% |
| octyl phenyl polyether alcohol (Triton X100) | 2% |
| quaternary phosphate ester (Monaquat PTC) | 1% |
| Distilled Water Q.S. | 100% |

Cleaning solutions were prepared by dissolving surfactants in distilled water and mixing well.

The cleaning solutions such as described in Examples I to II are particularly useful to the practitioner lens lab to remove pitch, finger oils, cosmetics, etc. which were deposited on the lens surface during processing. The cleaning solutions can be used to clean the lenses by practitioner before dispensing to patients for hard, as for example, rigid gas permeable, contact lenses.

While the cleaning solutions of Examples I to II are advantageous, the addition of abrasive particles has been found to give best results.

Contact lenses having a high fluorine content characteristically develop a tenacious waxy surface deposit that is difficult and often impossible to remove with conventional contact lens cleaners. The combination of several surfactants with abrasive particles will remove tenacious lens deposits such as lipid, protein, mucous, cosmetics, mascara, etc. The following are examples of such cleaning solutions:

| Formulation | Example A % by wt. | Example B % by wt. | Example C % by wt. |
|---|---|---|---|
| sodium tridecyl ether sulfate (Sipex EST-30) | 30 | 30 | 20 |
| Triton X-100 | 4 | — | 4 |
| Monaquat PTC (47% in $H_2O$) | 1.5 | 1.5 | 1.5 |
| silica gel** | 2 | 20 | — |
| NaCl | 10 | 100 | 100 |
| Water Q.S. | 1 ml | 1 ml | 1 ml |

**(Syloid 234, a trademark product of W.R. Grace of Baltimore, Maryland, made up of a synthetic amorphous silica having an average particle size of about 2.5 microns)

Dissolve NaCl in distilled water, add Syloid slowly with stirring and mix for 20 minutes. Followed by adding Monaquat PTC, sodium tridecylether sulfate, and alkyl phenyl polyether alcohol, stepwise, and mix the solution until no precipitation occurs.

The cleaning effectiveness of the solution was tested on the artificially coated contact lens flat surface which were prepared by boiling double-sided polished flats, with surface represents high quality optical finish found on actual contact lens surface, in an artificial tear solution consisting of the following for 1 hour:

| | |
|---|---|
| Albumin | 50 mg |
| Lysozyme | 215 mg |
| gamma globulin | 136 mg |
| Mucin | 200 mg |
| $CaCl_2$ | 4 mg |
| Lactoferrin | 150 mg |
| butyl stearate | 0.23 mg |
| cholesteryl oleate | 0.16 mg |
| cholesteryl palmitate | 0.16 mg |
| tripalmitin | 0.04 mg |
| cetyl alcohol | 0.03 mg |
| oleic acid | 0.1 mg |
| lecithin | 0.16 mg |

-continued

| | |
|---|---|
| $NaH_2PO_4$ | 55 mg |
| $Na_2HPO_4$ | 280 mg |
| pH = 7.4 | |
| water Q.S. | 100 ml |

This boiling procedure coated the surfaces of all the flats with a thick white greasy film. They were then dired in a 65° C. oven to ensure that the deposits were firmly bound to the surfaces. A modified crockmeter was utilized as the testing apparatus with the arm exerting a total load of150 gms on the sample flats. For details see U.S. Pat. No. 4,394,179.

It was found that formulation "A" was very effective in removing surface deposits. In fact, C was better than B, but less effective than A.

Generally, the combinations of sodium tridecyl ether sulfates and an octylphenyl polyether alcohol surfactant, along with silica gel and a suspending agent, have been found to be particularly useful and are believed to exhibit a synergistic result in cleaning hard contact lenses containing fluorine and silicone materials. Such contact lenses may, for example, be as described in U.S. Pat. No. 4,686,267, wherein a silicone acrylate material is augmented with a fluorine containing itaconate.

What is claimed is,

1. A contact lens cleaning material designed for cleaning hard contact lenses formed of silicon and fluorine containing polymers, after said lenses have been used in the eye, said cleaning material comprising, (a) an anionic surface active agent selected to have good cleaning action with respect to protein and mucous like material deposits, (b) an alkylphenyl polyether alcohol surfactant, (c) an aqueous suspending vehicle, (d) an inorganic abrasive having an average particle size of no more than about 20 microns, (e) separate means to maintain a, b and d in substantially uniform suspension, so that said suspension is capable of cleaning a contact lens without adversely affecting or scratching said lens, and, (f) a preservative and surfactant quaternary phosphate ester.

2. A contact lens cleaning material in accordance with claim 1 and further comprising a buffer to provide an overall pH of between 5 and 8.

3. A contact lens cleaning material in accordance with claim 1, wherein said alkylphenyl polyether alcohol has the following formula:

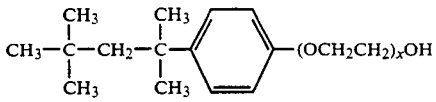

where x=at least 3.

4. A contact lens cleaning material in accordance with claim 3, wherein said surface active agent "a" has the following formula:

$$C_nH_{2n+1}(CH_2CH_2O)_xSO_3^-R^+$$

where x varies from 0 to 10 n varies from 8 to 20

$R^+$ is $Na^+$, $K^+$, $NH_4^+$ $\frac{1}{2}$ $Mg^+$ $(CH_2CH_2OH)_3NH^+$

5. A contact lens cleaning material in accordance with claim 1, wherein said inorganic abrasive is a silica gel.

6. A contact lens cleaning material in accordance with claim 5, wherein said separate means (e) is selected from the class consisting of inorganic salts and hydrophilic polymers.

7. A contact lens cleaning material in accordance with claim 1, wherein said components are present in amounts by weight as follows:

(a) 5 to 15%

(b) 1 to 10%

(c) 50 to 94%

(d) 0.1 to 5%

(e) 5 to 15%

8. A contact lens cleaning material in accordance with cliam 4, wherein said components are present in amounts by weight as follows:

(a) 5 to 15%

(b) 1 to 10%

(c) 50 to 94%

(d) 0.1 to 5%

(e) 5 to 15%

(f) 0.5 to 5%

9. A contact lens cleaning solution comprising a substantially uniform suspension of a slat, silica gel, sodium tridecyl ether sulfate, alkylphenyl polyether alcohol, water and a quaternary phosphate ester.

10. A method of cleaning a hard contact lens formed of a polymer having silicon and fluorine incorporated therein, after said lens has been used in the eye and has accumulated deposits from the eye, said method comprising, (a) exposing said contact lens to a solution containing in admixture, abrasive particles, an alkylphenyl polyether alcohol surfactant, a second surfactant which is anionic, a suspending agent, a preservative and surfactant quaternary phosphate ester, an aqueous suspending vehicle, and (b) rubbing said solution against said contact lens to remove surface deposits.

* * * * *